US005438726A

United States Patent [19]

Leite

[11] Patent Number: 5,438,726

[45] Date of Patent: Aug. 8, 1995

[54] TOOTH CLEANING SYSTEM WITH TIMER AND SIGNALING MEANS

[76] Inventor: Francisca P. Leite, 1558 E. 19th St., Brooklyn, N.Y. 11230

[21] Appl. No.: 239,377

[22] Filed: May 9, 1994

[51] Int. Cl.[6] ..... A46B 9/04

[52] U.S. Cl. ..... 15/105; 15/106; 15/110; 15/111; 15/167.1; 15/176.1; 15/176.2; 132/309; 132/325; 601/141; 606/161

[58] Field of Search ..... 15/22.1, 105, 106, 110, 15/111, 167.1, 176.1–176.6; 132/308–310, 321–325, 329; 601/139, 141, 142; 606/161

[56] References Cited

U.S. PATENT DOCUMENTS

| | | | |
|---|---|---|---|
| 2,084,873 | 6/1937 | Strause | 15/167.1 |
| 2,172,591 | 9/1939 | Peterson | 132/325 |
| 2,651,068 | 9/1953 | Seko | 606/161 |
| 3,050,072 | 8/1962 | Diener | 132/321 |
| 4,185,349 | 1/1980 | Papas | 15/106 |
| 4,205,664 | 6/1980 | Baccialon | 601/141 |
| 4,399,582 | 8/1983 | Ernest et al. | 15/167.1 |
| 4,543,679 | 10/1985 | Rosofsky et al. | 601/141 |
| 4,598,437 | 7/1986 | Ernest et al. | 15/167.1 |
| 4,679,272 | 7/1987 | Florence | 15/110 |
| 5,138,733 | 8/1992 | Bock | 15/167.1 |
| 5,165,131 | 11/1992 | Staar | 15/22.1 |

FOREIGN PATENT DOCUMENTS

| | | | |
|---|---|---|---|
| 537979 | 6/1922 | France | 606/161 |
| 2450579 | 11/1980 | France | 15/176.5 |
| 2503861 | 8/1976 | Germany | 132/324 |
| 2918806 | 11/1980 | Germany | 15/167.1 |
| 3149233 | 4/1983 | Germany | 15/167.1 |
| 154683 | 11/1920 | United Kingdom | 15/167.1 |
| 2236071 | 3/1991 | United Kingdom | 15/167.1 |
| 2250428 | 6/1992 | United Kingdom | 15/22.1 |
| 2252234 | 8/1992 | United Kingdom | 15/105 |

*Primary Examiner*—Mark Spisich
*Attorney, Agent, or Firm*—Michael I. Kroll

[57] ABSTRACT

A toothbrush with timer and signalling apparatus having interchangeable periodontal devices. The signalling apparatus is composed of both an audio and vibrating signalling device to alert the user when the preset time limit is achieved.

3 Claims, 2 Drawing Sheets

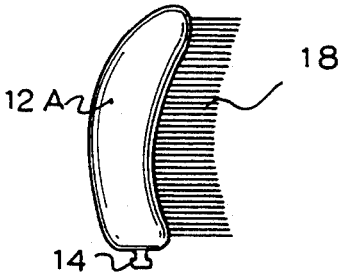
Fig. 3
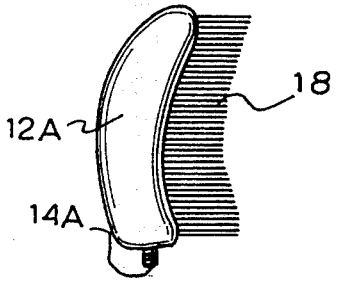
Fig. 3A
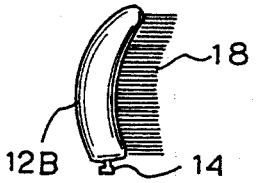
Fig. 4
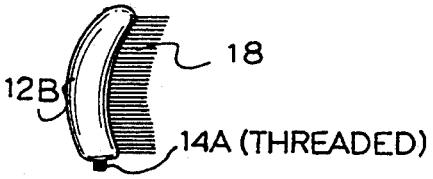
Fig. 4A
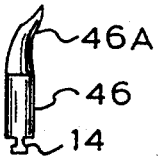
Fig. 5
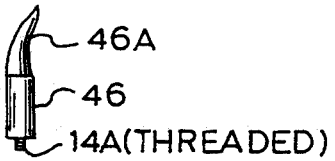
Fig. 5A
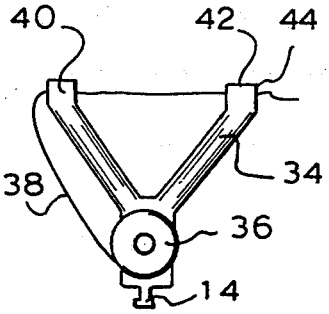
Fig. 6
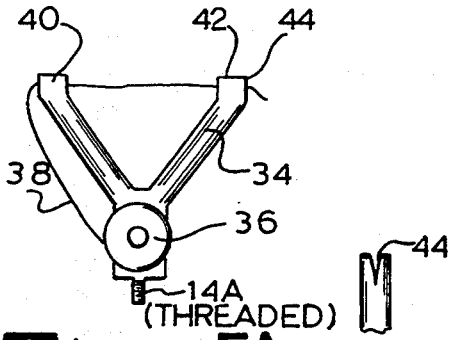
Fig 6A
Fig. 7

TOOTH CLEANING SYSTEM WITH TIMER AND SIGNALING MEANS

BACKGROUND OF THE INVENTION

1. Field of the Invention

The present invention relates to a toothbrush which includes a signal generating means.

This invention relates generally to toothbrush with timer means and more particularly, but not by way of limitation, to a toothbrush capable of alerting a user when sufficient time has elapsed to cease brushing.

2. Description of the Prior Art

The most widespread tooth diseases are cavities and parodontitis. Parodontitis is understood as being the gradual destruction of tooth-holding apparatus. Both diseases are caused by bacteria which collect in particular between the teeth and which form acids and poisons during the long chain of their destruction. It is this which forms the basis of the prophylaxis against these diseases, which is available to and readily applicable by anyone. Healthy nutrition specifically with regard to the teeth is surely among the initial prophylactic measures. By reducing the intake of sugar, the growth of bacteria, and hence also the formation of acids and poisons, can be minimized. However, completely dispensing with the consumption of sugar is hardly possible in daily life. If this fact is taken into account, oral hygiene is accordingly the most important factor in combatting cavities and parodontitis. Regular removal of food residues prevents a sharp increase in bacteria and consequently prevents, on the one hand, the formation of acids and, on the other hand, irritation of the gums by dead bacteria, which gives rise to the risk of parodontitis. Brushing the teeth for at least two minutes after each main meal is regarded as optimum.

It is precisely this simple prophylaxis which appears to present the greatest problems in daily life, not only in the case of children, whose dislike of cleaning teeth is well known, but also in the case of adults, who state that they have great difficulty in maintaining a minimum time for brushing their teeth.

Various attempts have been made to help maintain this time by providing acoustic and/or visual aids. Market observation and questionnaires show that the attempts made so far have not yet provided an attractive solution.

Numerous innovations for a toothbrush with timer and signaling means have been provided in the prior art that are described as follows. Even though these innovations may be suitable for the specific individual purposes to which they address, they differ from the present invention as hereinafter contrasted.

U.S. Pat. No. 4,788,734

Toothbrush having signal producing means

Gerfried Bauer

The handle part (2) of a toothbrush houses means which emit acoustic signals in the audible range of the human ear. The means are a chip (3), a battery (4), a sound generator (5), a sound amplifier (6) and a switch (7). By incorporating other similar means, the emission of visual signals is produced. The means (3, 4, 5, 6, 7), which are combined to form a module, are suitable for emitting a melody and/or spoken words. The chip (3) is supplemented with a "timer", the cycle of which is set, or can be set, and preferably lasts for two minutes per actuation. The battery (4) has a life of three months when used twice a day for two minutes in each case.

U.S. Pat. No. 5,184,959

Programmable toothbrush alarm unit

Harry W. Oryhon, and Jeremy Oryhon

A programmable device which emits an audible alarm to indicate one or more preselected tooth brushing times includes a display member set in a device housing, the housing having a number of toothbrush accommodating slots, each of the toothbrush-accommodating slots having an alarm switch associated therewith, the switch being disposed in an individual alarm circuit. The alarm switch is activated and reset by removal and insertion of the toothbrush into the slot.

U.S. Pat. No. 4,991,755

Toothpaste dispenser with timer assembly

Stephen Grusmark

A toothpaste dispenser including a timer device structured so that a person will receive a signal to indicate a time period of sufficient length has elapsed for the brushing of teeth. The timer assembly may include an activating structure directly thereon such as on an exposed face thereof wherein the activating structure is readily accessible from an extension of the dispenser. In another embodiment, the activating structure associated with the timer assembly is mounted at least partially on the interior of the housing of the toothpaste dispenser and connected to a dispensing plunger such that the time period for brushing teeth is automatically set concurrently to depressing of the plunger for the dispensing of toothpaste from the container.

U.S. Pat. No. 5,282,291

Force sensitive handle for hand operated implement

Eric L. Spieler, and Richard M. Berman

An improved handle for a hand operated implement of the type for which it is desirable to control the force of application. The handle has bifurcated sections which are connected by a means for sensing the applied force and indicating a variation of the applied force from a desired level.

U.S. Pat. No. 5,165,131

Teeth cleaning apparatus

Marcel J. H. Staar

A teeth cleaning apparatus has a brush pivotally mounted in a brush holder. The brush has a teeth cleaning member such as bristles formed thereon. A vibrator exerts a vibratory force on the brush so that the teeth cleaning member moves back and forth in substantially its axial direction. The vibrator is driven by an electrical signal which preferably is of a frequency between 1,000 and 17,000 Hz and includes an audio frequency component of mixed frequency and amplitude representing music or other pleasant sounds which is transmitted to the auditory system of a person while brushing.

U.S. Pat. No. 5,133,102

Electronic toothbrush

Shuji Sakuma

An electronic toothbrush has a handle accommodating a light-emitting diode and a sound-producing device as well as an electric circuit for actuating the diode and device. When a current is caused to flow through the toothbrush by grasping the brush and bringing it into contact with the teeth, light and sound are emitted to notify the user that the toothbrush is operating.

U.S. Pat. No. 5,044,037

Musical toothbrush

Kenneth A. Brown

The present invention relates to a novelty toothbrush. The toothbrush has a plastic member with a plurality of aligned holes at one end, a head and face portion at a second end and an integral handle for grasping the toothbrush. The toothbrush further has a series of bristles positioned within the holes for brushing teeth and massaging gums, a sound generator housed within the plastic member and a push-button device for actuating the sound generator to play a musical tune for a predetermined time period.

U.S. Pat. No. 4,866,807

Toothbrush

Erwin Kreit, and Hans Ineichen

The tooth brush comprises a figurehead detachably fixed to a handle. The head contains a module with at least one push button, a loudspeaker, a digital sound generator and a battery (19). When the button is pressed, a tune is generated by the sound generator for a particular period of time and played back through the loudspeaker. This design makes the toothbrush less expensive to produce and makes it easier for children to become accustomed to regular and thorough cleaning of their teeth.

Numerous innovations for a toothbrush with timer and signaling means have been provided in the prior art that are adapted to be used. Even though these innovations may be suitable for the specific individual purposes to which they address, they would not be suitable for the purposes of the present invention as heretofore described.

SUMMARY OF THE INVENTION

One object of the invention, as characterized in the claims, is to propose a toothbrush which, when used, makes it substantially easier to maintain the minimum time for brushing the teeth, which is recommended as a prophylaxis against cavities and parodontitis. This is achieved by objectifying the time on the one hand and on the other hand by making this particular period of time pleasant to the senses.

The essential advantages of the invention are that the desired objective can be achieved without the aid of external auxiliaries. By actuating a capacitive of inductive switch which is located in the handle of the toothbrush and, in a preferred embodiment of the invention, is positioned at thumb height in a conventional erogonomically designed toothbrush handle, the means housed there and preferably combined to form a single module are activated so that a beep and/or spoken words of any type are emitted. The signalling time corresponds to the time span which is regarded by dental science as being the optimum time for which the teeth should be brushed after each main meal, namely two minutes in each case.

This provides a sensitive pleasant component which, particularly in the case of children, acts as an encouragement and stimulus to clean the teeth regularly and to continue this process until the audio signal sounds.

In the case of adults, the objectification of time which this provides and which is signalled by completion of the emission is certainly of prime importance. Meanwhile, it should also be mentioned that the sound of, for example, a beep or signalling means which is a personal favorite will certainly also stimulate those who are no longer children to maintain the duration and repetitive nature of the process.

In another preferred embodiment of the invention, it is possible to generate vibrating signals, which may be particularly advantageous for the hard of hearing.

Another advantage of the invention is that the time when, for hygienic reasons, the toothbrush should be changed is unmistakably indicated by the absence of the emission, this time being related not so much to the wearing out of the bristles but primarily to the danger of transferring bacteria which multiply on the bristle part. When used twice a day for two minutes in each case, the battery has in fact a life of three months, that is to say the life after which dental science expects a toothbrush to be replaced.

The means are commercial elements, so that from the economic point of view the toothbrush is certainly disposable.

Another advantage of the invention is that the toothbrushes can be programmed with various sounds such as beeps. Hence, the acquisition of a new toothbrush affords the possibility of deciding in favor of a new sound or type of emission.

Furthermore, the toothbrush can readily be designed so that the bristle part is replaceable. In an embodiment of this type, it is advantageous for a snap-on and/or screw-in disposable bristle part to be connected to the handle containing a battery. Moreover, the bristle part may be electrically operated, with the result that brushing of the teeth is facilitated and intensified.

In addition, the toothbrush can readily be designed so that the part opposite the bristle end is also replaceable. In an embodiment of this type, it is advantageous for a snap-on and/or screw-in disposable part to contain a dental flossing device and/or pick, and/or tongue scraper. Moreover, the part may be electrically operated, with the result that cleaning the teeth, tongue and gums is facilitated and intensified.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

10—toothbrush with timer and signalling means
11—tongue scraper
12—standard interchangeable toothbrush head 12A—concave-shaped interchangeable toothbrush head
12B—compact interchangeable toothbrush head
14—interchangeable snap-on part
14A—interchangeable screw-in part
16—interchangeable snap-on part
16A—interchangeable screw-in part
18—bristles
20—top distal end of handle
22—middle of handle
24—bottom distal end of handle
26—display screen
28—on/off reset button
30—speaker
31—vibrating means
32—pick
34—dental floss apparatus
36—dental floss roll
38—dental floss
40—dental floss holder
42—dental floss holder with cutter
44—cutter
46—rubber headed gum massager
46A—rubber head
48—ergodynamically designed gripping means
50—battery

BRIEF DESCRIPTION OF THE DRAWING FIGURES

FIG. 3 is a side view of a concave-shaped interchangeable toothbrush head exhibiting bristles and interchangeable snap-on part.

FIG. 3A is a side view of a concave-shaped interchangeable toothbrush head exhibiting bristles and interchangeable screw-in part.

FIG. 4 is a side view of a compact interchangeable toothbrush head exhibiting bristles and interchangeable snap-on part.

FIG. 4A is a side view of a compact interchangeable toothbrush head exhibiting bristles and interchangeable screw-in part.

FIG. 5 is a side view of a rubber headed gum massager exhibiting a rubber head and interchangeable snap-on part.

FIG. 5A is a side view of a rubber headed gum massager exhibiting a rubber head and interchangeable screw-in part.

FIG. 6 is a side view of a dental floss apparatus exhibiting the following features: dental floss roll, dental floss, dental floss holder and dental floss holder with cutter.

FIG. 6A is a side view of a dental floss apparatus exhibiting the following features: dental floss roll, dental floss, dental floss holder and dental floss holder with cutter.

FIG. 7 is a side view of a dental floss cutter exhibiting a v-shaped sharpened cutting means.

DETAILED DESCRIPTION OF THE PREFERRED EMBODIMENT

Figure 1:
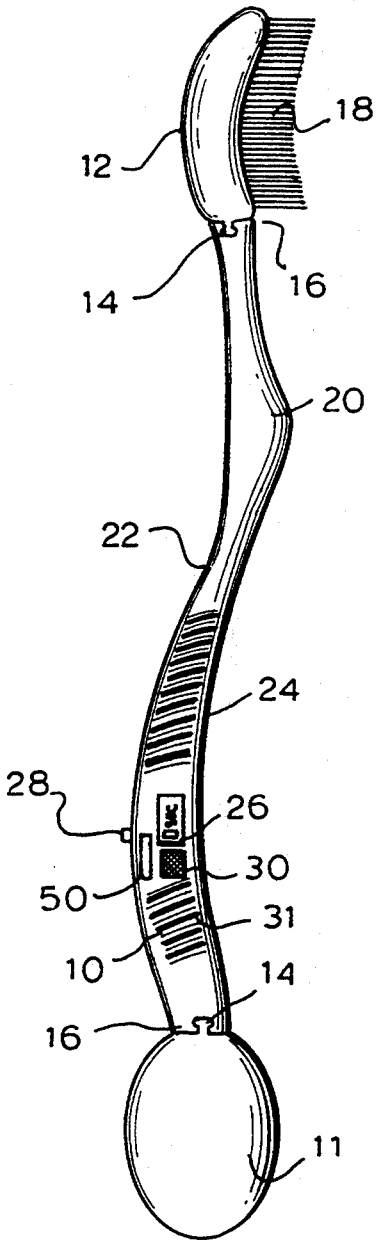
FIG. 1 is a side view of a toothbrush with timer and signalling means exhibiting the following features: tongue scraper, standard interchangeable toothbrush head with bristles, interchangeable snap-on part, top distal end of handle, middle of handle, bottom distal end of handle, display screen, on/off reset button, speaker and vibrating means and battery.

Firstly, referring to FIG. 1 which is a side view of a toothbrush with timer and signalling means 10 exhibiting a tongue scraper 11, standard interchangeable toothbrush head 12 with bristles 18, interchangeable snap-on part 14, interchangeable snap-on part 16, top distal end of handle 20, middle of handle 22, bottom distal end of handle 24, display screen 26, on/off reset button 28, speaker 30, vibrating means 31 and battery 50. The interchangeable parts, such as standard interchangeable toothbrush head 12, concave-shaped interchangeable toothbrush head 12A, compact interchangeable toothbrush head 12B, pick 32, rubber headed gum massager 46, and dental floss apparatus 34 are capable of being interchanged between the top distal end of handle 20 and the bottom distal end of handle 24. All interchangeable parts having a similar interchangeable snap-on part 14 and the top distal end of handle 20 and the bottom distal end of handle 24 having similar interchangeable snap-on part 16. Therefore, versatility is achieved within the device having interchangeability such that combinations of said toothbrush with timer and signalling means 10 may have a toothbrush head 12 at one distal end while having a pick 32 at the other distal end and/or having toothbrush head 12 at one distal end while having a rubber gum massager at the other distal end and/or toothbrush head 12 at one distal end while having a dental floss apparatus 34 at the other distal end and/or dental floss apparatus 34 at one distal end while having a pick 32 at the other distal end.

Figure 1A:
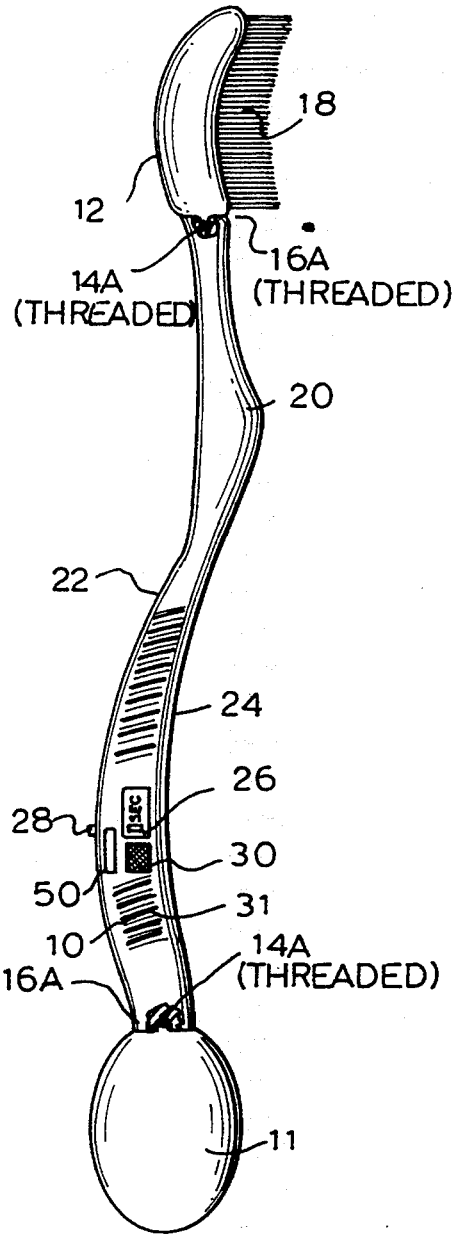
FIG. 1A is a side view of a toothbrush with timer and signalling means exhibiting the following features: tongue scraper, standard interchangeable toothbrush head with bristles, interchangeable screw-in part, top distal end of handle, middle of handle, bottom distal end of handle, display screen, on/off reset button, speaker and vibrating means and battery.

Referring now to FIG. 1A which is a side view of a toothbrush with timer and signalling means 10 exhibiting a tongue scraper 11, standard interchangeable toothbrush head 12 with bristles 18, interchangeable screw-in part 14A, interchangeable screw-in part 16A, top distal end of handle 20, middle of handle 22, bottom distal end of handle 24, display screen 26, on/off reset button 28, speaker 30, vibrating means 31 and battery 50. The interchangeable parts, such as standard interchangeable toothbrush head 12, concave-shaped interchangeable toothbrush head 12A, compact interchangeable toothbrush head 12B, pick 32, rubber headed gum massager 46, and dental floss apparatus 34 are capable of being interchanged between the top distal end of handle 20 and the bottom distal end of handle 24. All interchangeable parts having a similar interchangeable screw-in part 14A and the top distal end of handle 20 and the bottom distal end of handle 24 having similar interchangeable screw-in part 16A. Therefore, versatility is achieved within the device having interchangeability such that combinations of said toothbrush with timer and signalling means 10 may have a toothbrush head 12 at one distal end while having a pick 32 at the other distal end and/or having toothbrush head 12 at one distal end while having a rubber gum massager at the other distal end and/or toothbrush head 12 at one distal end while having a dental floss apparatus 34 at the other distal end and/or dental floss apparatus 34 at one distal end while having a pick 32 at the other distal end.

When the timer mechanism is turned on or reset via the on/off reset button 28 and a time is displayed on the display screen 26, said time is sequentially adjusted accordingly and displayed on the display screen 26 until the time is expired at which time a signalling means is activated such that an audio signal is emitted via the speaker 30 and/or vibrating means 31 functioning to alert a user when said time limit is reached.

Figure 2:
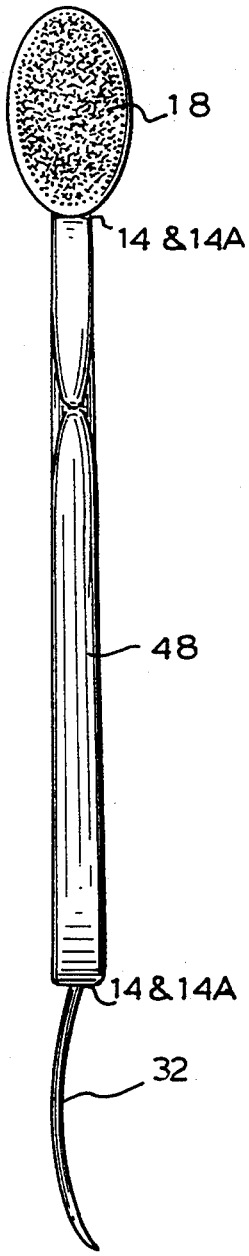
FIG. 2 is a front view of a toothbrush with timer and signalling means exhibiting a standard interchangeable toothbrush head with bristles at one distal end, a pick at the other distal end, and an ergodynamically designed gripping means on the tooth brush handle.

Referring now to FIG. 2 which is a front view of a toothbrush with timer and signalling means 10 exhibiting a standard interchangeable toothbrush head 12 with bristles 18 at top distal end of handle 20, a pick 32 at the bottom distal end of handle 24, and an ergodynamically designed gripping means 48 on the tooth brush handle.

Referring now to FIG. 3 which is a side view of a concave-shaped interchangeable toothbrush head 12A exhibiting bristles 18 and interchangeable snap-on part 14.

Referring now to FIG. 3A which is a side view of a concave-shaped interchangeable toothbrush head 12A exhibiting bristles 18 and interchangeable screw-in part 14A.

Referring now to FIG. 4 which is a side view of a compact interchangeable toothbrush head 12B exhibiting bristles 18 and interchangeable snap-on part 14.

Referring now to FIG. 4A which is a side view of a compact interchangeable toothbrush head 12B exhibiting bristles 18 and interchangeable screw-in part 14A.

Referring now to FIG. 5 which is a side view of a rubber headed gum massager 46 exhibiting a rubber head 46A and interchangeable snap-on part 14.

Referring now to FIG. 5A which is a side view of a rubber headed gum massager 46 exhibiting a rubber head 46A and interchangeable screw-in part 14A.

Referring now to FIG. 6 which is a side view of a dental floss apparatus 34 exhibiting the following features: dental floss roll 36, dental floss 38, dental floss holder 40, dental floss holder 42 with cutter 44, and interchangeable snap-on part 14.

Referring now to FIG. 6A which is a side view of a dental floss apparatus 34 exhibiting the following features: dental floss roll 36, dental floss 38, dental floss holder 40, dental floss holder 42 with cutter 44 and interchangeable screw-in part 14A.

Referring now to FIG. 7 which is a side view of a dental floss cutter 44 exhibiting a V-shaped sharpened cutting means functioning to cut dental floss 38 therein.

It will be understood that each of the elements described above, or two or more together, may also find a useful application in other types of constructions differing from the type described above.

While the invention has been illustrated and described as embodied in a toothbrush with timer and signalling means, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A tooth cleaning system with timer and signalling means comprising:

a) a handle having a top end with an interchangeable attachment means contained therein, a middle of said handle including a display screen which both displays and counts down a predetermined time period, an on/off reset button, a speaker, and a vibrating means, and a bottom end with an interchangeable attachment means contained therein, said handle having an ergodynamically designed gripping means conforming to a user's hand;

b) a plurality of interchangeable periodontal devices each with a complimentary interchangeable engagement part for releasable attachment to the attachment means at either the top or bottom end of said handle, said periodontal devices including a toothbrush head, a tongue scraper, concave-shaped toothbrush head, compact toothbrush head, pick, dental floss apparatus having a roll of dental floss with cutter, and rubber headed gum massager so that said user can select any two devices at any one time to mount on the top and bottom ends of said handle; and c) electronic means within said handle operatively connecting together the display screen, on/off reset button, speaker and vibrating means such that it functions as a timing, signalling and signalling activation means for said on/off reset button to set a preselected period of time at the end of which according to the selection by the user the screen will display the expiration of the time, the speaker will emit an audio signal, and said vibrating means will vibrate in said handle to alert said user.

2. The tooth cleaning system of claim 1 in which said attachment means are snap-on devices.

3. The tooth cleaning system of claim 1 in which said attachment means are screw-on devices.

* * * * *